US008973285B2

(12) United States Patent
Fujitomo

(10) Patent No.: US 8,973,285 B2
(45) Date of Patent: Mar. 10, 2015

(54) GRAIN-DRYING FACILITIES

(75) Inventor: Hirota Fujitomo, Tokyo (JP)

(73) Assignee: Satake Corporation, Tokyo (JP)

( * ) Notice: Subject to any disclaimer, the term of this patent is extended or adjusted under 35 U.S.C. 154(b) by 255 days.

(21) Appl. No.: 13/642,520

(22) PCT Filed: Mar. 17, 2011

(86) PCT No.: PCT/JP2011/056335
§ 371 (c)(1),
(2), (4) Date: Oct. 22, 2012

(87) PCT Pub. No.: WO2011/132481
PCT Pub. Date: Oct. 27, 2011

(65) Prior Publication Data

US 2013/0036624 A1 Feb. 14, 2013

(30) Foreign Application Priority Data

Apr. 22, 2010 (JP) ..... 2010-098628

(51) Int. Cl.
*F26B 3/06* (2006.01)
*F26B 23/02* (2006.01)
(Continued)

(52) U.S. Cl.
CPC ..... *F26B 23/022* (2013.01); *F26B 2200/06* (2013.01); *F26B 9/087* (2013.01); *F26B 17/1416* (2013.01); *F26B 23/02* (2013.01)
USPC ..... 34/565; 34/168; 34/182; 166/245; 110/238; 432/29

(58) Field of Classification Search
USPC ..... 34/565, 539, 68, 168, 182; 60/690; 166/66.5, 245, 267; 56/432; 110/215, 110/238; 432/29
See application file for complete search history.

(56) References Cited

U.S. PATENT DOCUMENTS 5,960,558 A * 10/1999 Bourgault ..... 34/495
6,006,440 A * 12/1999 Wiesenhofer et al. ..... 34/305
(Continued)

FOREIGN PATENT DOCUMENTS

CN 1263248 A 8/2000
CN 1285495 A 2/2001
(Continued)

*Primary Examiner* — Steve M Gravini
(74) *Attorney, Agent, or Firm* — Joseph P. Farrar, Esq.

(57) ABSTRACT

The present invention provides grain-drying facilities which can effectively use the heat energy of a biomass combustion hot-air that has been generated in a biomass combustion furnace.

The grain-drying facilities adopt technical means of providing the grain-drying facilities 1 which include: a biomass combustion furnace 3 provided with a heat exchanger 24 for generating hot air on the basis of a combustion heat of a biomass fuel and an outside air which has been taken in from the outside; and a circulation type grain-drying apparatus 2 provided with a grain-drying portion 7 to which the hot air that has been generated in the biomass combustion furnace 3 is supplied through a pipe 15 for supplying the hot air, wherein the above described circulation type grain-drying apparatus 2 has a grain-heating portion 6 which has a plurality of heating pipes 6*a* for heating the grains in the above described grain storing/circulating tank 5, and also has an air-exhaust fan 14 that is communicated with an exhaust side opening 6*c* that is located in one end side of each of the heating pipes 6*a*, and has a pipe 11 for supplying an exhaust hot-air, which communicates the exhaust hot-air sent from the above described biomass combustion furnace 3 with a supply side opening 6*b* that is located in the other end side of the heating pipe 6*a*.

10 Claims, 3 Drawing Sheets

(51) Int. Cl.
*F26B 9/08* (2006.01)
*F26B 17/14* (2006.01)

(56) References Cited

U.S. PATENT DOCUMENTS

| | | | | |
|---|---|---|---|---|
| 6,092,301 | A * | 7/2000 | Komanowsky | 34/263 |
| 6,209,223 | B1 * | 4/2001 | Dinh | 34/86 |
| 6,219,937 | B1 * | 4/2001 | Culp et al. | 34/396 |
| 6,223,451 | B1 | 5/2001 | Satake et al. | |
| 6,318,000 | B1 | 11/2001 | Satake et al. | |
| 6,996,918 | B2 * | 2/2006 | Bsirske et al. | 34/265 |
| 7,100,301 | B1 * | 9/2006 | Humphrey et al. | 34/86 |
| 7,404,262 | B2 * | 7/2008 | Jurkovich et al. | 34/381 |
| 8,161,661 | B2 * | 4/2012 | Bartol | 34/86 |
| 8,726,539 | B2 * | 5/2014 | Potter et al. | 34/427 |
| 8,793,897 | B2 * | 8/2014 | Brosig et al. | 34/303 |
| 2007/0137537 | A1 * | 6/2007 | Drisdelle et al. | 110/297 |
| 2013/0036624 | A1 * | 2/2013 | Fujitomo | 34/539 |
| 2014/0250718 | A1 * | 9/2014 | Fujitomo | 34/565 |

FOREIGN PATENT DOCUMENTS

| | | | |
|---|---|---|---|
| JP | 56-25678 | A | 3/1981 |
| JP | 56-149543 | A | 11/1981 |
| JP | 62-190380 | A | 8/1987 |
| JP | 2005-114238 | A | 4/2005 |
| JP | 4189665 | B2 | 4/2005 |

* cited by examiner

GRAIN-DRYING FACILITIES

BACKGROUND OF THE INVENTION

1. Technical Field

The present invention relates to grain-drying facilities which combust a biomass fuel such as a rice husk in a combustion furnace, supply the hot air which has been generated by the combustion as a hot air for drying, and dry grains.

2. Background Art

Grain-drying facilities are conventionally known which combust the rice husk that is one of the biomass fuel in a combustion furnace, supply the generated hot air to a heat exchanger, heat the outside air that has been taken into the heat exchanger, generate the hot air thereby, further add an auxiliary hot-air that has been generated by a kerosene oil burner to this hot air, and supply the mixed air to a grain-drying apparatus. The temperature of the above described hot air is adjusted by mixing the hot air with the outside air, and the hot air is supplied to the grain-drying apparatus as a drying air.

CITATION LIST

Patent Literature

Japanese Patent Laid-Open No. 62-190380

SUMMARY OF THE INVENTION

Technical Problem

However, in the above described grain-drying facilities, the hot air (hereinafter referred to as biomass combustion hot-air) which has been generated in the combustion furnace (hereinafter referred to as biomass combustion furnace) for the combustion of the biomass is exhausted in a state of having yet included the heat energy, though a part of its heat quantity is consumed in the heat exchanger, and accordingly it is expected to effectively use the heat energy which is yet contained in the exhaust air.

Then, the present invention has been designed with respect to the above described problems, and a technological object of the present invention is to provide grain-drying facilities which can effectively use the heat energy of the biomass combustion hot-air that has been generated in the biomass combustion furnace.

This technological object has been solved in the following way.

As is described in claim 1, the grain-drying facilities of the present invention employ technical means of providing the grain-drying facilities 1 which include:

a biomass combustion furnace 3 provided with a heat exchanger 24 for generating hot air on the basis of a combustion heat of a biomass fuel and an outside air which has been taken in from the outside; and a circulation type grain-drying apparatus 2 provided with a grain-drying portion 7 to which the hot air that has been generated in the biomass combustion furnace 3 is supplied through a pipe 15 for supplying the hot air, wherein the circulation type grain-drying apparatus 2 has a grain-heating portion 6 for heating the grains in a grain storing/circulating tank 5, wherein the grain-heating portion 6 has a plurality of heating pipes 6*a* which penetrate the grain storing/circulating tank and come in contact with the grains on the external surface, also has an air-exhaust fan 14 which is communicated with an exhaust side opening 6*c* that is located in one end side of each of the heating pipes 6*a*, and has a pipe 11 for supplying an exhaust hot-air, which communicates the exhaust hot-air sent from the biomass combustion furnace 3 with a supply side opening 6*b* that is located in the other side of the heating pipe 6*a*.

In addition, as is described in claim 2, the grain-drying facilities employ technical means of providing the grain-drying facilities according to claim 1, wherein the heat exchanger 24 of the biomass combustion furnace 3 generates the hot air on the basis of the combustion heat of the biomass fuel and the outside air which has been taken in from the outside; the hot air is supplied to the grain-drying portion 7 through a pipe 15 for supplying the hot air, and also the exhaust hot-air is supplied to the grain-heating portion 6 from an exhaust pipe 25 of the biomass combustion furnace 3 through the pipe 11 for supplying the exhaust hot-air.

Furthermore, as is described in claim 3, the grain-drying facilities employ technical means of providing outside air intake portions 12 and 16 for taking in the outside air, in the pipe 15 for supplying the hot air and the pipe 11 for supplying the exhaust hot-air, and providing also outside air intake quantity adjustment portions 12*a* and 16*a* in the outside air intake portions 12 and 16.

Furthermore, as is described in claim 4, the grain-drying facilities employ technical means of providing a drying portion temperature sensor 7*h* for measuring the temperature of the hot air which has been supplied, in the grain-drying portion 7, and also providing a control section 4 for driving the air volume adjustment portion 15*a* and the outside air intake quantity adjustment member 16*a* on the basis of the temperature which has been measured by the drying portion temperature sensor 7*h*, and adjusting the quantity of the supplied hot air and the quantity of the taken-in outside air.

Furthermore, as is described in claim 5, the grain-drying facilities employ technical means of providing a heating portion temperature sensor 6*f* for measuring the temperature of the supplied exhaust hot-air in the grain-heating portion 6, and also providing a control section 4 which drives an air volume adjustment portion 11*a* and an outside air intake portion 12*a* on the basis of the temperature that has been measured by the heating portion temperature sensor 6*f*, and adjusts the quantity of the supplied exhaust hot-air and the quantity of the taken-in outside air.

In addition, as is described in claim 6, the grain-drying facilities employ technical means of attaching a bypass pipe line 11*b* to the pipe 11 for supplying the exhaust hot-air, which supplies the exhaust hot-air to the air-exhaust fan 14 through a flow channel switching valve 11*c*, instead of supplying the exhaust hot-air to the heating pipe 6*a* through the pipe 11.

In addition, as is described in claim 7, the grain-drying facilities employ such technical means that the grain-heating portion 6 includes a plurality of heating pipes 6*a* which penetrate the grain storing/circulating tank 5 and come in contact with the grains on the external surface, the exhaust pipe 25 of the biomass combustion furnace 3 is connected to supply side openings of the plurality of the heating pipes 6*a* so as to be communicated with the heating pipes, and on the other hand, an air-exhaust fan 14 is arranged so as to be communicated with exhaust side openings of the plurality of the heating pipes 6*a*.

In addition, as is described in claim 8, the grain-drying facilities employ technical means of attaching a bypass pipe line 11*b* to the pipe 11 for supplying the exhaust hot-air, which supplies the exhaust hot-air to the air-exhaust fan 14 through a flow channel switching valve 11*c*, instead of supplying the exhaust hot-air to the heating pipe 6*a* through the pipe 11.

Advantageous Effects of Invention

The grain-drying facilities of the present invention generate hot air in a heat exchanger by using a biomass combustion heat (biomass combustion hot-air) which has been generated in the biomass combustion furnace, supply the hot air as hot air for drying grains in the circulation type grain-drying apparatus, and also use the biomass combustion hot-air which yet includes remaining heat energy after the biomass combustion heat has been used in the above described heat exchanger, by supplying the biomass combustion hot-air to the grain-heating portion for heating the grains in the circulation type grain-drying apparatus. As a result, the heat energy of the above described biomass combustion heat can be effectively used for drying the grains without wasting the heat energy. Besides, the above described circulation type grain-drying apparatus has the grain-heating portion, thereby can change the grains in a pre-stage before the grains are dried by ventilation in the grain-drying portion, into a state in which the moisture in the inner part of the grains has been migrated to the surface side of the grains by a heating action of the grain-heating portion, accordingly shows excellent drying efficiency when drying the grains by ventilation in the grain-drying portion, and can shorten a drying period of time. In addition, the grain-drying facilities do not use a kerosene burner or the like for generating the hot air for drying, and accordingly can dry the grains while saving energy.

DETAILED DESCRIPTION OF THE INVENTION

Figure 1:
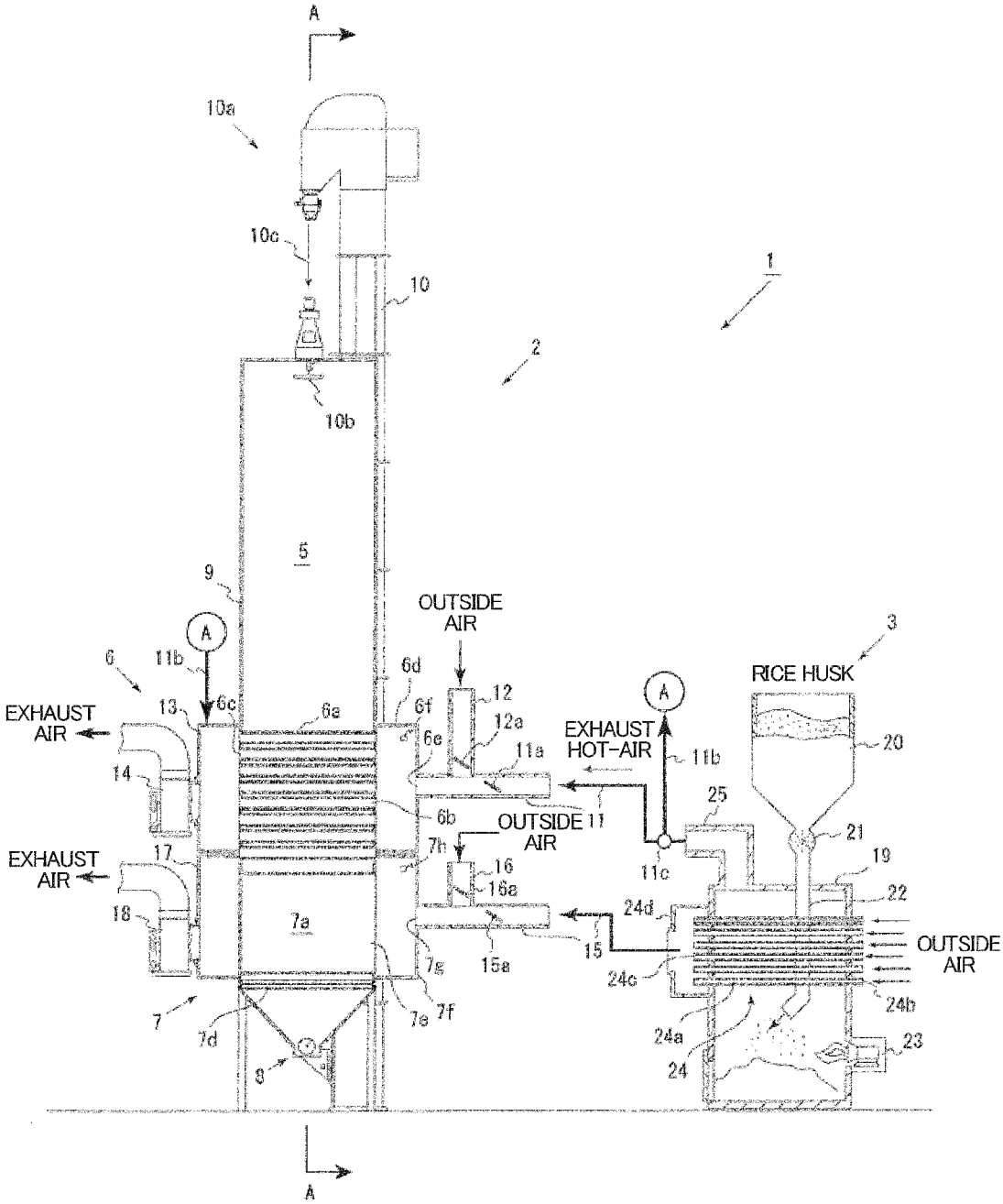
FIG. 1 is a longitudinal sectional view illustrating grain-drying facilities of the present invention.
Figure 2:
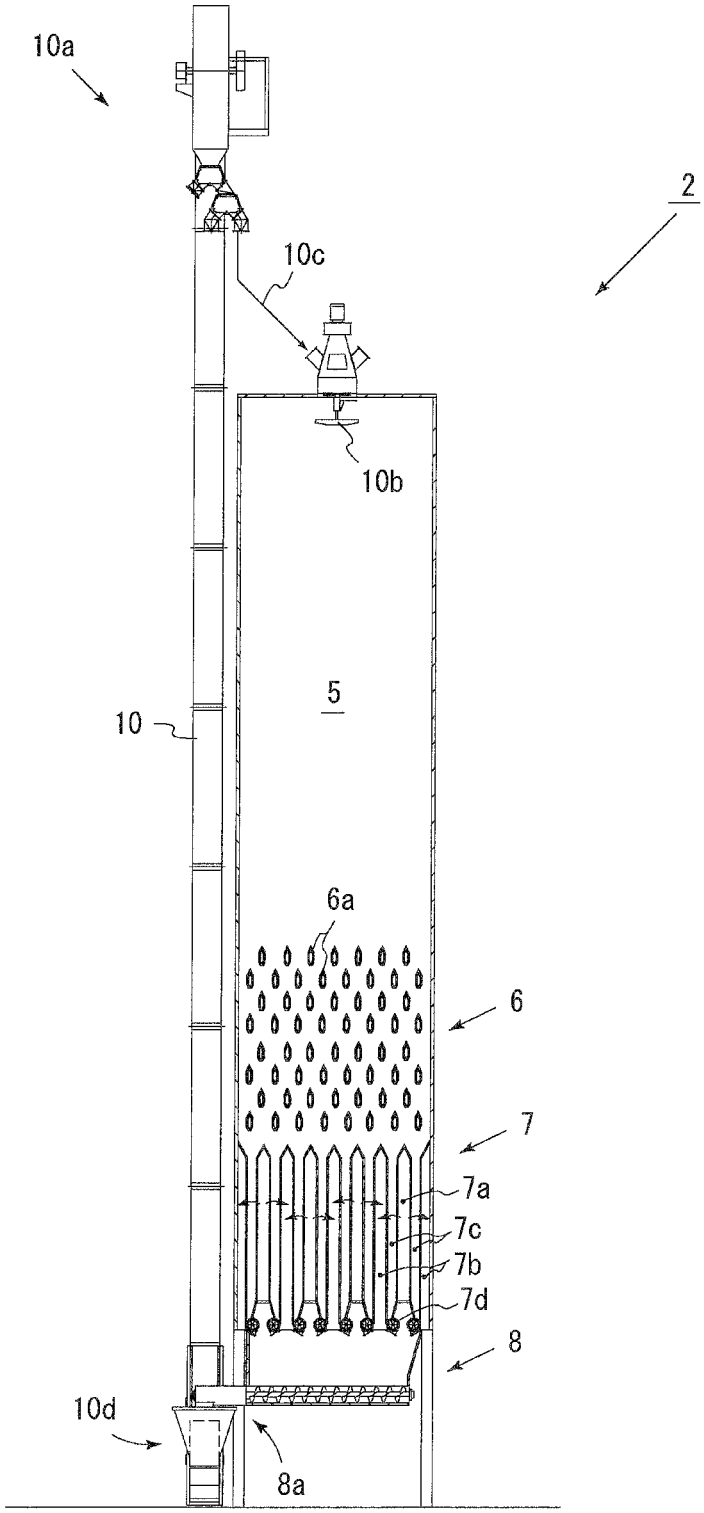
FIG. 2 is a sectional view taken along a line A-A of a circulation type grain-drying apparatus in grain-drying facilities of the present invention.
Figure 3:
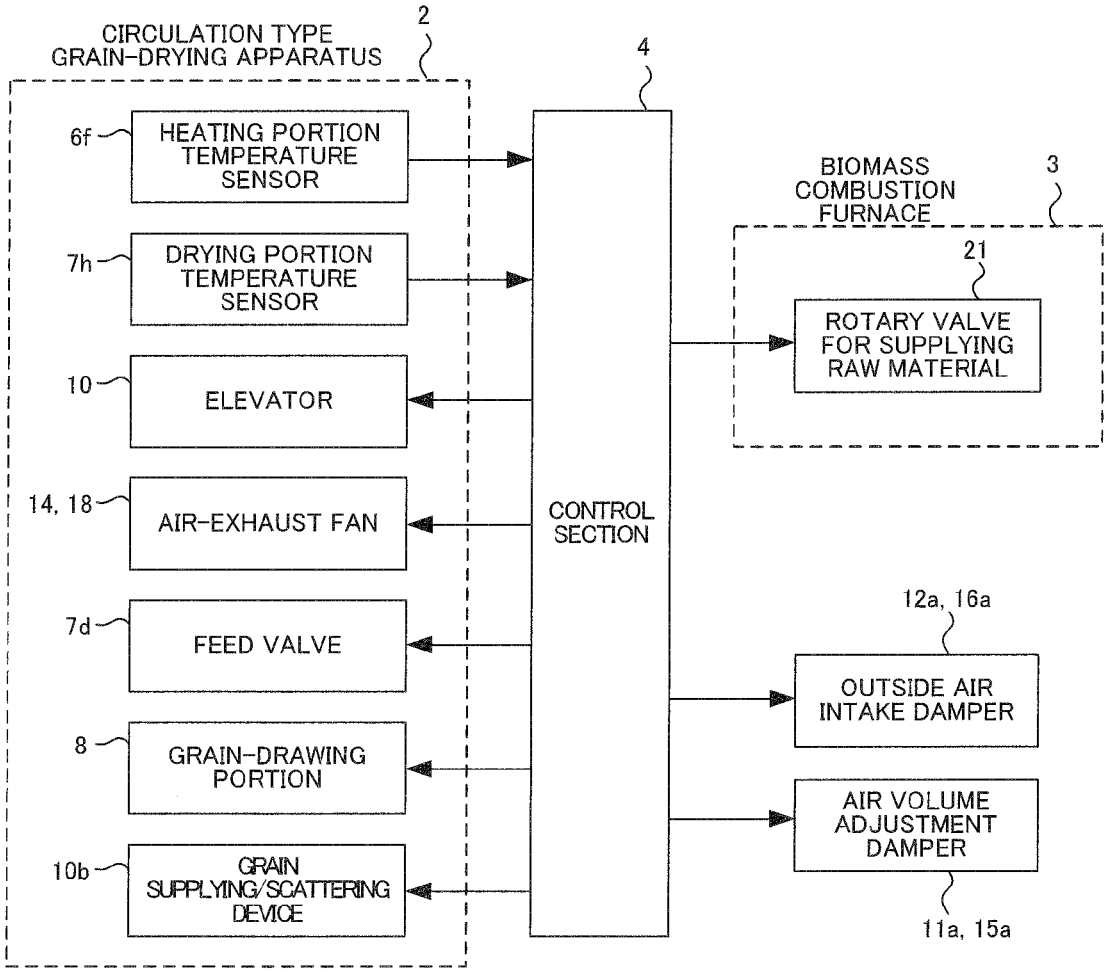
FIG. 3 is a block diagram of control in grain-drying facilities of the present invention.

Embodiments according to the present invention will be described below with reference to FIG. 1 and FIG. 2. FIG. 1 illustrates grain-drying facilities 1 of the present invention. Grain-drying facilities 1 include a circulation type grain-drying apparatus 2, a biomass combustion furnace 3 and a control section 4 (FIG. 3).

Circulation Type Grain-Drying Apparatus 2:

The above described circulation type grain-drying apparatus 2 has a main body portion having a grain storing/circulating tank 5, a grain-heating portion 6, a grain-drying portion 7 and a grain-drawing portion 8 arranged so as to be sequentially stacked therein, and also an elevator 10 for returning the grains which have been discharged from the above described grain-drawing portion 8 to the grain storing/circulating tank 5. The above described grain storing/circulating tank 5 has a grain supplying/scattering device 10*b* provided in the upper part. The discharge side 10*a* of the above described elevator 10 communicates with the above described grain supplying/scattering device 10*b* through a pipe line 10*c* so that the discharged grains are returned therethrough. On the other hand, the supply side 10*d* (FIG. 2) of the above described elevator 10 communicates with a discharge side 8*a* of the above described grain-drawing portion 8.

The above described grain-heating portion 6 has a plurality of heating pipes 6*a* which heat the grains. The plurality of the heating pipes 6*a* are structured to be arranged in such a horizontal state as to traverse the main body portion 9 from one side to the other side, in parallel to each other, and in a staggered state in upper and lower directions (in state in which positions of heating pipes 6*a* in upper row and positions of heating pipes 6*a* in lower row do not overlap each other in upper and lower directions). Accordingly, the grains come in contact with the external surface of the heating pipe 6*a* as flowing down. It is preferable to form the shape of the heating pipe 6*a* in a longitudinal cross section of the main body portion into such a shape that the right and left faces in the upper part have downwardly tilting shapes, as is illustrated in FIG. 2, in order to enhance the flowing down action of the grains.

Both of a supply side opening 6*b* and a discharge side opening 6*c* in each of the above described heating pipes 6*a* are structured so as to be opened to the outside of the main body portion 9 (FIG. 1). A cover member 6*d* for supplying the exhaust hot-air is arranged in the above described main body portion 9 so as to surround all of the above described supply side openings 6*b*. A port 6*e* for introducing the exhaust hot-air is provided in the above described cover member 6*d* for supplying the exhaust hot-air, and a pipe line 11 (pipe for supplying exhaust hot-air) for supplying the exhaust hot-air which has been exhausted from a biomass combustion furnace 3 that will be described later is connected to the port 6*e* for introducing the exhaust hot-air. A heating portion temperature sensor 6*f* (FIG. 1) for measuring the temperature of the supplied exhaust hot-air is arranged in the inner part of the above described cover member 6*d* for supplying the exhaust hot-air. The heating portion temperature sensor 6*f* is set so as to transmit its temperature measurement value to a control section 4 which will be described later.

An air volume adjustment damper 11*a* (air volume adjustment portion) for adjusting the air volume of the above described exhaust hot-air is provided in the inner part of the above described pipe line 11. In addition, the above described pipe line 11 has an outside air introduction pipe 12 (outside air intake portion) connected thereto at a position between a position at which the above described air volume adjustment damper 11*a* is provided and the port 6*e* for introducing the exhaust hot-air, and at the same time, the above described outside air introduction pipe 12 has an outside air intake damper 12*a* (outside air intake quantity adjustment portion) for adjusting the opening and closing of a flow channel provided in the inner part. The above described air volume adjustment damper 11*a* and the outside air intake damper 12*a* employ an automatic flow channel opening/closing damper or the like, which receives a signal sent from the control section 4 that will be described later, is automatically adjusted to be opened or closed according to the signal, and can adjust the air volume.

On the other hand, all of the discharge side openings 6*c* of each of the above described heating pipes 6*a* are structured so as to be surrounded by an air-exhaust cover 13 arranged in the above described main body portion 9. The air-exhaust fan 14 is provided at the air-exhaust cover 13.

A bypass pipe line 11*b* is provided at the above described pipe line 11. This bypass pipe line 11*b* is structured so as to communicate an arbitrary position in the above described pipe line 11 with the above described air-exhaust cover 13. This bypass pipe line 11*b* is a component for bypassing a portion of the heating pipe 6*a* to make the exhaust hot-air pass therethrough so that the exhaust hot-air in an initial period when the combustion has started in the biomass combustion furnace 3 does not pass through the above described heating pipe 6*a*. The exhaust hot-air in the initial period when the combustion has started, which has passed through the bypass pipe line 11*b*, is exhausted to the outside from the inside of the air-exhaust cover 13 by the air-exhaust fan 14. A flow channel switching damper (flow channel switching valve) 11*c* is provided at a position in the downstream side of a position to which the bypass pipe line 11*b* is connected, in the inner part of the above described pipe line 11. The flow channel switching damper 11*c* shall automatically switch the flow channel according to a signal sent from the control section 4 which will be described later.

The above described grain-drying portion 7 has a plurality of hot air bodies 7*a*, a plurality of exhaust air bodies 7*b* and a plurality of grain flowing down layers 7*c*, respectively. The above described hot air body 7*a* is structured so as to form a hollow shape by installing pairs of ventilation plates formed of a perforated iron plate or the like in an upright form at a predetermined space so as to oppose to each other. The exhaust air body 7*b* is also structured so as to form a hollow shape by installing pairs of ventilation plates formed of a perforated iron plate or the like in an upright form at a predetermined space so as to oppose to each other. The above described hot air body 7*a* and the above described exhaust air body 7*b* are alternately arranged at a predetermined space, and the grain flowing down layer 7*c* is structured so as to be located between the above described hot air body 7*a* and the above described exhaust air body 7*b*. A feed valve 7*d* for grains is provided in the lower end portion of each grain flowing down layer 7*c*.

In addition, the above described hot air body 7*a* is structured so that all of supply side openings 7*e* in one side thereof are opened to the outside of the main body portion 9. As for each of the above described supply side openings 7*e*, a cover member 7*f* for supplying the hot air (FIG. 1) is arranged on the above described main body portion 9 so as to surround all of the supply side openings 7*e*. The cover member 7*f* for supplying the hot air has a port 7*g* for introducing the hot air, and a pipe line 15 (pipe for supplying hot air) for supplying the hot air is connected thereto which has been generated in the biomass combustion furnace 3 that will be described later. A drying portion temperature sensor 7*h* for measuring the temperature of the supplied hot air is arranged in the inner part of the above described cover member 7*f* for supplying the hot air. The temperature sensor 7*h* is set so as to transmit a temperature measurement value to the control section 4 which will be described later.

An air volume adjustment damper 15*a* (air volume adjustment portion) for adjusting the air volume of the above described hot air is provided in the inner part of the above described pipe line 15. In addition, the above described pipe line 15 has an outside air introduction pipe 16 (outside air intake portion) connected thereto at a position between a position at which the above described air volume adjustment damper 15*a* is provided and the port 7*g* for introducing the hot air. An outside air intake damper 16*a* (outside air intake quantity adjustment portion) for adjusting the opening and closing of the flow channel is provided in the inner part of the above described outside air introduction pipe 16. The above described air volume adjustment damper 15*a* and the outside air intake damper 16*a* employ an automatic flow channel opening/closing damper or the like, which receives a signal sent from the control section 4 that will be described later, and can automatically adjust the air volume according to the signal.

On the other hand, the discharge side opening (not-shown) which is located in the exhaust side (left side in FIG. 1) of each of the above described exhaust air bodies 7*b* (FIG. 2) is structured so as to be opened to the outside of the main body portion 9. In addition, as for the above described discharge side opening, the air-exhaust cover 17 is arranged on the above described main body portion 9 so as to surround all of the discharge side openings. An air-exhaust fan 18 is arranged so as to communicate with the internal space formed by the air-exhaust cover 17.

Biomass Combustion Furnace 3:

The above described biomass combustion furnace 3 has a combustion furnace 19 provided therein which combusts the biomass fuel such as a rice husk. The combustion furnace 19 has a tank portion 20 for supplying the raw material provided on its upper part, and a rotary valve 21 for supplying the raw material is provided in the discharge side of the tank portion 20 for supplying the raw material. A transport pipe 22 for transporting the biomass fuel which has been fed from the above described rotary valve 21 for supplying the raw material to the bottom part in the combustion furnace 19 is connected to the discharge side of the rotary valve 21 for supplying the raw material.

An ignition burner 23 for igniting biomass (rice husk, wood waste, fermentation cake, dried feces and the like) which has been supplied to the bottom part in the combustion furnace 19 is provided in the lower part of the above described combustion furnace 19. In addition, a heat exchanger 24 for generating hot air is provided in the upper part of the above described combustion furnace 19. The above described heat exchanger 24 is formed of a plurality of heat exchange pipes 24*a* which penetrate the upper part of the combustion furnace 19 from one side face to the other side face and are arranged in parallel with each other. In each of the heat exchange pipes 24*a*, an outside air suction port 24*b* is provided in one side, and a hot air discharge port 24*c* is provided in the other side. As for the hot air discharge port 24*c*, a hot air discharge cover member 24*d* is arranged on the above described combustion furnace 19 so as to surround all of the hot air discharge ports 24*c*. The hot air discharge cover member 24*d* communicates with the above described pipe line 15.

The above described combustion furnace 19 has an exhaust pipe 2 for discharging the exhaust hot-air (biomass combustion hot-air) after the biomass combustion hot-air which has been generated by the combustion of the biomass fuel has been used for the heat exchanger 24 provided in its upper part, and the exhaust pipe 25 is communicated with the above described pipe line 11.

The above described structure of the biomass combustion furnace 3 is one example, and should not limit the present invention.

Control Section 4:

The above described control section 4 is connected to each of the above described heating portion temperature sensor 6*f*, the drying portion temperature sensor 7*h*, the air passage adjustment dampers 11*a* and 15*a*, the outside air intake dampers 12*a* and 16*a*, the rotary valve 21 for supplying the raw material and the ignition burner 23, and controls the air passage adjustment dampers 11*a* and 15*a*, the outside air intake dampers 12*a* and 16*a*, and the rotary valve 21 for supplying the raw material, on the basis of the measurement temperature sent from the above described heating portion temperature sensor 6*f* and the drying portion temperature sensor 7*h*.

Action:

The action of the above described grain-drying facilities 1 will be described below.

Firstly, the above described biomass combustion furnace 3 starts the combustion. When the above described biomass combustion furnace 3 starts the combustion, the above described rotary valve 21 for supplying the raw material starts driving on the basis of the signal sent from the above described control section 4, and the above described tank portion 20 for supplying the raw material supplies the biomass fuel (rice husk and the like) to the inside of the combustion furnace 19. On the other hand, the above described ignition burner 23 starts driving, ignites the above described biomass fuel and starts the combustion, and thereby the combustion furnace 3 produces the biomass combustion hot-air. Incidentally, the above described ignition burner 23 stops the ignition after the biomass fuel has ignited.

On the other hand, the above described circulation type grain-drying apparatus 2 also starts driving according to the signal to start driving, which has been sent from the above described control section 4. (Incidentally, here, it is assumed that a filling operation of charging grains into grain storing/circulating tank 5, and making the grains be in a state to be dried has been already completed). Thereby, in the above described circulation type grain-drying apparatus 2, each of the above described air-exhaust fans 14 and 17, the elevator 10, the feed valve 7*d*, the grain supplying/scattering device 10*b* and the grain-drawing portion 8 starts driving.

In the above described biomass combustion furnace 3, when the biomass fuel is a rice husk, the exhaust hot-air (biomass combustion hot-air) which is discharged from the above described exhaust pipe 25 in an initial period after the combustion has been started contains much oil such as tar. Accordingly, in order to avoid the exhaust hot-air, the flow channel is switched to the bypass pipe line 11*b* by the above described flow channel switching damper 11*c* only for a predetermined period of time, and the exhaust hot-air is exhausted through the bypass pipe line 11*b* to the outside by the air-exhaust fan 14. Thereby, the above described initial exhaust hot-air is not supplied to the above described grain-heating portion 6, and does not exert a bad influence on the grain quality, by any chance. Thus, the safety is considered.

The above described heat exchanger 24 sucks the outside air to the inside of heat exchange pipes 24*a* by the sucking action of the above described air-exhaust fan 18, receives a combustion heat of the hot air due to the biomass combustion of the rice husk, and generates hot air. The hot air which has been generated in the above described heat exchanger 24 is supplied to the grain-drying portion 7 through a hot air discharge cover 24*d*, a pipe line 15 and a cover member 7*f* for supplying the hot air. The hot air which has been supplied to the grain-drying portion 7 entered into each of the above described hot air bodies 7*b* (FIG. 2), then passes between the grains in the grain flowing down layer 7*c*, enters into the exhaust air body 7*b*, then passes through the inner part of the above described air-exhaust cover 17, and is exhausted from the air-exhaust fan 18. The grains in the above described grain storing/circulating tank 5 receive a ventilation action of the hot air due to the driving of the above described feed valve 7*d* when sequentially flowing down through the grain flowing down layer 7*c*, and then are returned to the grain storing/circulating tank 5 through the elevator 10 or the like.

On the other hand, when the predetermined period of time (for instance, 30 minutes) has passed after the combustion has started in the above described biomass combustion furnace 3, the flow channel is switched by driving the above described flow channel switching damper 11*c*, in order to stop the exhaust of the above described exhaust hot-air to the outside of the apparatus through the bypass pipe line 11*b* and supply the exhaust hot-air to the above described grain-heating portion 6. Then, the above described exhaust hot-air passes through the inside of each of the heating pipes 6*a* through the above described pipe line 11 and the cover member 6*d* for supplying the exhaust hot-air, heats each of the heating pipes 6*a*, then passes through the inner part of the air-exhaust cover 13, and is exhausted from the air-exhaust fan 14. Thereby, the grains in the above described grain storing/circulating tank 5 come in contact with an external surface of the above described heating pipe 6*a* when flowing down around the heating pipe 6*a* or receive a heating action from the heating pipe 6*a* due to the radiant heat and the like, when flowing down around the heating pipe 6*a*, and cause such an action that the moisture in the inner part of the grains migrates to the surface side of the grains. After this, the grains receive the ventilation action of the hot air when flowing down through the grain flowing down layer 7*c* in the above described grain-drying portion 7, and the moisture which has migrated to the surface side of the grains is removed. For this reason, the circulation type grain-drying apparatus shows excellent drying efficiency, and can shorten a drying period of time.

The above described control section 4 controls the temperature adjustment for the temperature of the exhaust hot-air to be supplied to the above described grain-heating portion 6, and the temperature of the hot air to be supplied to the grain-drying portion 7. The above described control section 4 adjusts and controls the temperature of the exhaust hot-air to be supplied to the grain-heating portion 6, by outputting a drive signal to the air passage adjustment damper 11*a* and the outside air intake damper 12*a* so that the detected temperature is controlled within a predetermined temperature range (for instance, 80° C. to 120° C.) which has been previously determined, on the basis of the detected temperature of the above described heating portion temperature sensor 6*f*, and making the dampers change the quantity of the opening/closing. The above described control section 4 also adjusts and controls the temperature of the hot air to be supplied to the grain-drying portion 7 in a similar way to the above description, by outputting a drive signal to the air passage adjustment damper 15*a* and the outside air intake damper 16*a* so that the detected temperature is controlled within a predetermined temperature range (for instance, 43° C. to 50° C.) which has been previously determined, on the basis of the detected temperature of the above described drying portion temperature sensor 7*h*, and making the dampers change the quantity of the opening/closing.

Furthermore, when the above described temperature of the exhaust hot-air and the temperature of the hot air do not enter the above described predetermined temperature range, even by having changed the quantity of the opening/closing of the air passage adjustment dampers 11*a* and 15*a* and the outside air intake dampers 12*a* and 16*a* in the above described way, the above described control section 4 changes the combustion quantity itself of the rice husk by stopping the driving of the rotary valve 21 for supplying the raw material of the above described biomass combustion furnace 3 or changing the rotation speed.

As described above, the grain-drying facilities 1 of the present invention use the combustion heat of the biomass fuel such as the rice husk, use the hot air which has been generated in the heat exchanger 24, and also use the heat energy remaining after having been used in the above described heat exchanger 24 as the exhaust hot-air in the grain-heating portion 6 of the above described circulation type grain-drying apparatus; and accordingly can effectively use the above described heat energy and also show the excellent efficiency of drying of the grains. In addition, the grain-drying facilities do not use a kerosene burner or the like for generating the hot air for drying, and accordingly can dry the grains while saving energy.

INDUSTRIAL APPLICABILITY

The present invention is effective as grain-drying facilities which effectively use the combustion heat of a biomass fuel such as a rice husk, and at the same time, can efficiently dry grains while saving energy.

REFERENCE SIGNS LIST

1 Grain-drying facilities
2 Circulation type grain-drying apparatus
3 Biomass combustion furnace
4 Control section
5 Grain storing/circulating tank
6 Grain-heating portion
6*a* Heating pipe
6*b* Supply side opening
6*c* Discharge side opening
6*d* Cover member for supplying exhaust hot-air
6*e* Port for introducing exhaust hot-air
6*f* Heating portion temperature sensor
7 Grain-drying portion
7*a* Hot air body
7*b* Exhaust air body
7*c* Grain flowing down layer
7*d* Feed valve
7*e* Supply side opening
7*f* Cover member for supplying hot air
7*g* Port for introducing hot air
7*h* Drying portion temperature sensor
8 Grain-drawing portion
8*a* Discharge side
9 Main body portion
10 Elevator
10*a* Discharge side
10*b* Grain supplying/scattering device
10*c* Pipe line
10*d* Supply side
11 Pipe line (pipe for supplying exhaust hot-air)
11*a* Air volume adjustment damper (air volume adjustment portion)
11*b* Bypass pipe line
11*c* Flow channel switching damper (flow channel switching valve)
12 Outside air introduction pipe (outside air intake portion)
12*a* Outside air intake damper (outside air intake quantity adjustment portion)
13 Air-exhaust cover
14 Air-exhaust fan
15 Pipe line (pipe for supplying hot air)
15*a* Air volume adjustment damper (air volume adjustment portion)
16 Outside air introduction pipe (outside air intake portion)
16*a* Outside air intake damper (outside air intake quantity adjustment portion)
17 Air-exhaust cover
18 Air-exhaust fan
19 Combustion furnace
20 Tank portion for supplying raw material
21 Rotary valve for supplying raw material
22 Transport pipe
23 Ignition burner
24 Heat exchanger
24*a* Heat exchange pipe
24*b* Outside air suction port
24*c* Hot air discharge port
24*d* Hot air discharge cover member
25 Exhaust pipe

The invention claimed is:

1. Grain-drying facilities comprising a biomass combustion furnace and a circulation type grain-drying apparatus, wherein the biomass combustion furnace is provided with a heat exchanger which heats an outside air that has been taken in from the outside by the combustion heat of a biomass fuel, and generates hot air, and with an exhaust pipe, and the circulation type grain-drying apparatus is provided with a grain-drying portion and a grain-heating portion, in a grain storing/circulating tank, wherein the grain-drying portion is a portion in which the hot air that has been generated in the heat exchanger passes among grains, and from which the hot air is discharged to the outside; and the grain-heating portion is a portion in which an exhaust hot-air is introduced from the exhaust pipe of the biomass combustion furnace into the heating pipe which penetrates the grain storing/circulating tank and comes in contact with the grains on the external surface, and the grains are heated by the heat.

2. Grain-drying facilities comprising a biomass combustion furnace and a circulation type grain-drying apparatus, wherein the biomass combustion furnace is provided with a heat exchanger which generates hot air on the basis of the combustion heat of a biomass fuel and an outside air that has been taken in from the outside, and with an exhaust pipe, and the circulation type grain-drying apparatus is provided with a grain-drying portion and a grain-heating portion, in a grain storing/circulating tank, wherein the grain-drying portion is a portion to which the hot air that has been generated in the heat exchanger is supplied through a pipe for supplying the hot air, in which the hot air passes among grains, and from which the hot air is discharged to the outside; and the grain-heating portion is a portion in which an exhaust hot-air is introduced through the pipe for supplying the exhaust hot-air from the exhaust pipe of the biomass combustion furnace into the heating pipe which penetrates the grain storing/circulating tank and comes in contact with the grains on the external surface, and the grains are heated by the heat.

3. The grain-drying facilities according to claim 2, further comprising air volume adjustment portions for adjusting the quantity of a supplied air provided in the pipe for supplying the hot air and the pipe for supplying the exhaust hot-air, respectively.

4. The grain-drying facilities according to claim 3, further comprising outside air intake portions for taking in an outside air provided in the pipe for supplying the hot air and the pipe for supplying the exhaust hot-air respectively, wherein the outside air intake portions have outside air intake quantity adjustment portions provided therein.

5. The grain-drying facilities according to claim 4, further comprising: a drying portion temperature sensor which measures the temperature of the hot air that has been supplied to the drying portion provided in the grain-drying portion; and a control section provided therein which drives the air volume adjustment portion and the outside air intake quantity adjustment portion, on the basis of the temperature that has been measured by the drying portion temperature sensor, and adjusts the quantity of the supplied hot air and the quantity of the taken-in outside air.

6. The grain-drying facilities according to claim 4, further comprising: a heating portion temperature sensor for measuring the temperature of the supplied exhaust hot-air arranged in the grain-heating portion; and a control section provided therein which drives the air volume adjustment portion and the outside air intake portion on the basis of the temperature that has been measured by the heating portion temperature sensor, and adjusts the quantity of the supplied exhaust hot-air and the quantity of the taken-in outside air.

7. The grain-drying facilities according to claim 1, wherein the grain-heating portion includes a plurality of heating pipes which penetrate the grain storing/circulating tank and come in contact with the grains on the external surface, the exhaust pipe of the biomass combustion furnace is connected to supply side openings of the plurality of the heating pipes so as to be communicated with the heating pipes, and on the other hand, an air-exhaust fan is arranged so as to be communicated with exhaust side openings of the plurality of the heating pipes.

8. The grain-drying facilities according to claim 7, further comprising a bypass pipe line arranged at the pipe for supplying the exhaust hot-air, which makes the exhaust hot-air bypass the heating pipe by using a flow channel switching valve and deliver the exhaust hot-air to the air-exhaust fan, without supplying the exhaust hot-air to the heating pipe.

9. The grain-drying facilities according to claim 2, wherein the grain-heating portion includes a plurality of heating pipes which penetrate the grain storing/circulating tank and come in contact with the grains on the external surface, the exhaust pipe of the biomass combustion furnace is connected to supply side openings of the plurality of the heating pipes so as to be communicated with the heating pipes, and on the other hand, an air-exhaust fan is arranged so as to be communicated with exhaust side openings of the plurality of the heating pipes.

10. The grain-drying facilities according to claim 9, further comprising a bypass pipe line arranged at the pipe for supplying the exhaust hot-air, which makes the exhaust hot-air bypass the heating pipe by using a flow channel switching valve and deliver the exhaust hot-air to the air-exhaust fan, without supplying the exhaust hot-air to the heating pipe.

* * * * *